US005117652A

United States Patent [19]

Takeuchi et al.

[11] Patent Number: 5,117,652

[45] Date of Patent: Jun. 2, 1992

[54] AIR CONDITIONER

[75] Inventors: Tomoyoshi Takeuchi, Mishima; Kiyosi Horimizu, Fujinomiya; Takehiko Sato; Kouji Wada, both of Fuji, all of Japan

[73] Assignee: Kabushiki Kaisha Toshiba, Kawasaki, Japan

[21] Appl. No.: 648,231

[22] Filed: Jan. 31, 1991

[30] Foreign Application Priority Data

Mar. 30, 1990 [JP] Japan ..... 2-84662
Mar. 30, 1990 [JP] Japan ..... 2-84666
Mar. 30, 1990 [JP] Japan ..... 2-84674

[51] Int. Cl.[5] ..... F28D 5/00

[52] U.S. Cl. ..... 62/291; 62/305; 62/506

[58] Field of Search ..... 62/305, 506, 291, 429

[56] References Cited

U.S. PATENT DOCUMENTS 2,296,997 9/1942 Knoy ..... 62/506 X
2,736,176 2/1956 Carlton ..... 62/291
3,006,613 10/1961 Coyne ..... 62/429 X
3,026,690 3/1962 Deverall ..... 62/305
3,435,631 4/1969 Wood, Jr. ..... 62/305
3,635,046 1/1972 Sato et al. ..... 62/305
4,069,689 1/1978 Larriva ..... 62/305
4,918,943 4/1990 Faust ..... 62/305

FOREIGN PATENT DOCUMENTS 0341370 11/1989 European Pat. Off. .

*Primary Examiner*—William E. Tapolcai
*Attorney, Agent, or Firm*—Cushman, Darby & Cushman

[57] ABSTRACT

An air conditioner comprises a compressor for compressing and circulating a coolant in the cooling circuit, a condenser of the air cooling type for cooling and condensing the compressed coolant, a condenser of the water cooling type for further cooling and condensing the coolant which has been condensed by the air cooling condenser, and two independent air passages through which air is supplied to both of the air and water cooling condensers, respectively.

12 Claims, 12 Drawing Sheets

AIR CONDITIONER

BACKGROUND OF THE INVENTION

1. Field of the Invention

The present invention relates to an air conditioner of the carrier type wherein all of means for forming the cooling cycle can be housed in a body of the air conditioner and the air conditioner body itself can be carried to any optional position in a room which is to be cooled.

2. Description of the Related Art

There is a case where the space of a room which is to be cooled by heat exchange may be small although the room itself has a relatively large space. In other words, the space of a room which is to be cooled by heat exchange is sometimes wanted to change it smaller or larger.

It is advantageous in this case to use such an air conditioner that enables all of means for forming the cooling cycle to be housed in a body of the air conditioner and the air conditioner body itself to be carried to any optional position in the room.

An example of this carrier type air conditioner is disclosed in the Japanese Utility Model Publication Sho 52-17969, for example.

The air conditioner body of this carrier type is divided into cooling and machine chambers by a partition wall and the cooling chamber houses an evaporator, a cooled air blowing fan and the like, having at the front side a grille through which air in the room is sucked and another grille through which cooled air is blown out. A compressor, a heat exchanger of the air cooling type which is a heating condenser, a sprinkler means, a heat exchanger of the water cooling type which is an evaporating condenser, a water tank, a pump and the like are arranged in the machine chamber, which has at one side a grille through which heat exchanging air is sucked.

The water cooling heat exchanger, the sprinkler means, the air cooling heat exchanger and the like are enclosed by an air collecting cover. A casing in which a fan is housed is connected to a discharging opening of the air collecting cover. The casing is provided with an air exhausting opening to which a flexible exhausting pipe communicated with outside the room is connected.

A coolant, high in temperature and pressure, discharged from the compressor is introduced at first to the air cooling heat exchanger and then to the water cooling heat exchanger where it is condensed in the case of this air conditioner. The pump is driven at the same time and water is sprinkled over the water cooling heat exchanger by the sprinkler means while applying pressure to water in a water tank. The water sprinkled is evaporated while taking heat from the water cooling heat exchanger and introduced to the air cooling heat exchanger by which it is heated to raise its temperature and lower its relative humidity. The fan is also driven and heat exchanging air introduced into the machine chamber through the heat exchanging air sucking grille is cooled while exchanging heat with the water cooling heat exchanger. It is mixed here with vapor of the water which has been sprinkled by the sprinkler means and evaporated, to become air of high humidity including a large amount of vapor and then introduced to the air cooling heat exchanger. The mixed air, high in humidity, is heated while exchanging heat with the air cooling heat exchanger to raise its temperature and lower its relative humidity. The air of high temperature and humidity after the heat exchanging process is guided to the casing along the air collecting cover and exhausted outside the room through the air exhausting opening and pipe.

The air cooling heat exchanger exchanges heat with the air of high humidity and the water cooling heat exchanger exchanges heat with the water sprinkled by the sprinkler means and the heat exchanging air sucked. The coolant is condensed in this manner.

All of heat to be discharged from the air conditioner which serves as an air cooling machine is exhausted outside the room through the exhausting pipe. This enables the air conditioner body to be located at any position in the room. The air exhausted outside the room has been heated by the air cooling heat exchanger to lower its relative humidity to some extent, but it is air high in temperature and humidity and also high in thermal density. Therefore, no water drop is condensed on inner faces of the casing and air exhausting opening and pipe through which it is passed.

In the case of this air conditioner, however, it is disadvantageous that the efficiency of heat exchange is low particularly in the air cooling heat exchanger. The air cooling heat exchanger is located above the water cooling heat exchanger with the sprinkler means interposed between them. The air cooling heat exchanger is located downstream the water cooling heat exchanger in an air passage through which the heat exchanging air is passed from the heat exchanging air sucking grille to the exhausting pipe by the fan driven. This causes air, which comprises mixing vapor of water sprinkled over the water cooling heat exchanger by the sprinkler means and evaporated with air introduced by the fan to exchange heat with the water cooling heat exchanger, to be introduced to the air cooling heat exchanger. This mixed air has a temperature considerably higher than the temperature in the room which is to be cooled, and it also has an extremely high humidity.

On the other hand, the coolant introduced to the air cooling heat exchanger just after it is discharged from the compressor is high in temperature and it must exchange heat with the mixed air which is relatively high in temperature and extremely high in humidity. Therefore, the efficiency of heat exchange in the air cooling heat exchanger becomes low, thereby making it difficult to lower the temperature of the coolant to a predetermined value.

As the result, load is excessively added to the water cooling heat exchanger in the course of heat exchange and the amount of water in the water tank used up is considerably increased and the amount of water evaporated in the course of heat exchange is increased accordingly. When the amount of water remaining in the water tank becomes a little, it must be added. The cooling operation of the air conditioner must be stopped while water is being added to the water tank. This causes the time period, during which the cooling operation is continued, to become short and the number of times, at which water is added to the water tank, to be increased. This is trouble- some and the temperature in the room which is to be cooled is raised every time the cooling operation is stopped, thereby making it difficult to keep the room comfortable.

Further, another factor which causes the efficiency of heat exchange in the air cooling heat exchanger to be lowered is the amount of air selected by the fan to blow or send humid air. When the amount of air blown out by the fan is too much, the humid air sent from the water cooling heat exchanger is passed through the air cooling heat exchanger without sufficiently contacting the air cooling heat exchanger. Namely, there is a fear that water drops in the humid air are exhausted outside the room through the exhausting pipe without exchanging heat with the air cooling heat exchanger. When the amount o air blown out by the fan is too little, however, the amount of water drops evaporated while the heat of the humid air is being exchanged with the air cooling heat exchanger exceeds that of water drops newly sent. These water drops are left not evaporated, remaining between fins which form the heat exchanger. This causes the efficiency of heat exchange to be lowered in the air cooling heat exchanger.

Still further, the air cooling heat exchanger is at all times in high humid air which is almost vapor, and it is thus contacted with water drops. This causes the fins to be eroded in a relatively short time period.

SUMMARY OF THE INVENTION

The object of the present invention is to provide an air conditioner capable of enhancing the efficiency of heat exchange in the air cooling heat exchange and preventing fins which form the heat exchanger from being eroded.

This object can be achieved by an air conditioner comprising a compressor for compressing and circulating a coolant in a cooling circuit, a condenser of the air cooling type for cooling and condensing the compressed coolant, a condenser of the water cooling type for further cooling and condensing the coolant which has been condensed by the air cooling condenser, an evaporator for evaporating the condensed coolant, and two independent air passages through which air is supplied to both of the air and water cooling condensers, respectively.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will be described in detail with reference to the accompanying drawings.

Figure 1:
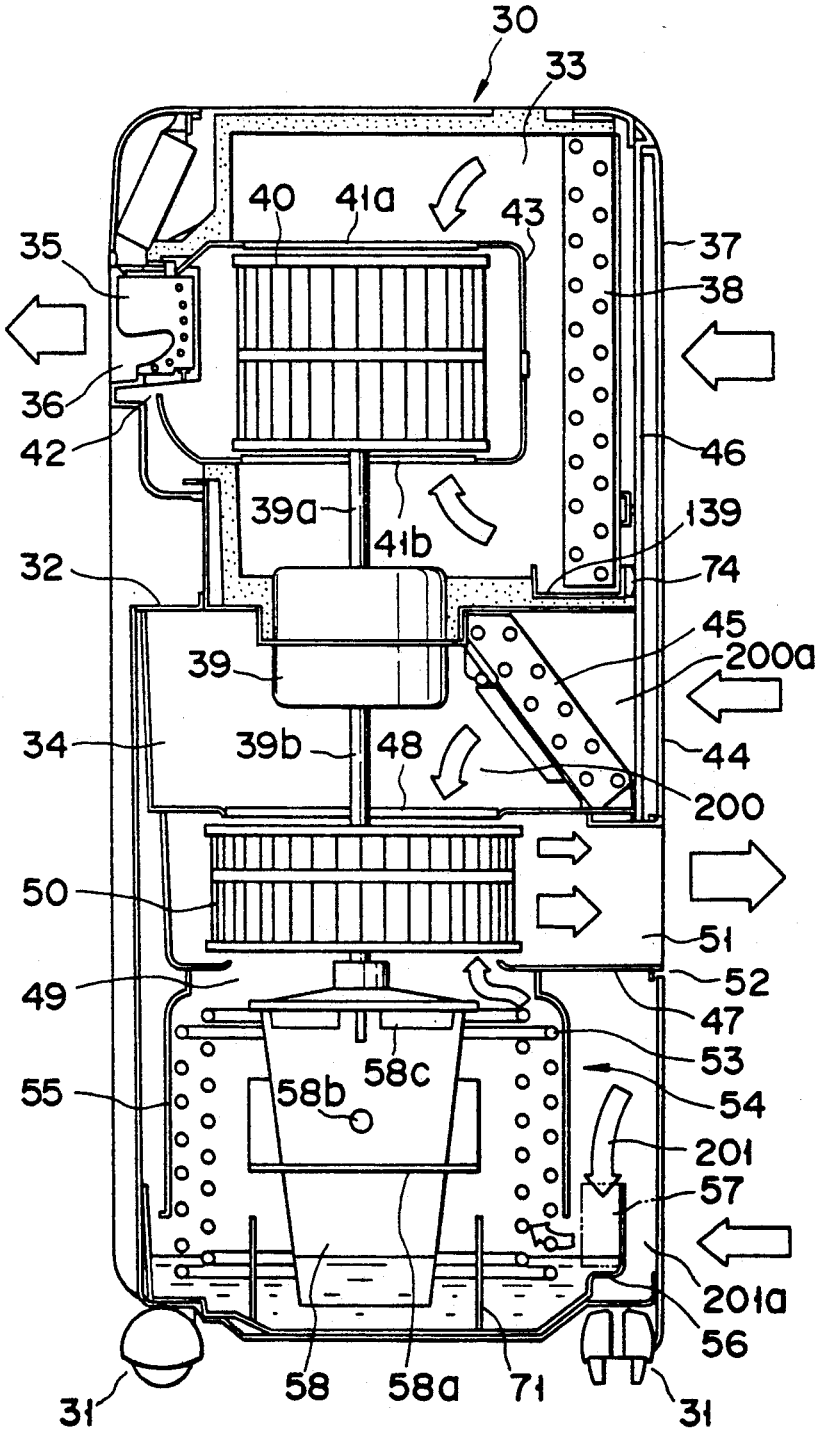
FIG. 1 is a vertically-sectioned view showing an example of the air conditioner according to the present invention.

Reference numeral 30 in FIG. 1 denotes an air conditioner body which is provided with plural wheels 31 on the underside thereof to enable it to be carried on the floor of a room. The inside of this air conditioner body 30 is divided into an upper cooling chamber 33 and a lower machine chamber 34 by a horizontal partition wall 32. A grille 36 through which cooled air is blown out and which is provided with a louver 35 for adjusting the direction of the cooled air blown out is arranged on the front side of the cooling chamber 33. A sucking grille 37 is arranged on the rear side of the cooling chamber 33 and an evaporator 38 which forms the cooling cycle is located in opposite to the sucking grille 37. A drain pan 139 is located under the evaporator 38 to receive drain water created by the evaporator 38.

A motor 39 which has rotating shafts **39*a* and 39*b* projected outside from its top and bottom is held, passing through the partition wall 32. These shafts 39*a* and 39*b* are directed vertical and a first fan 40 is attached to the rotating shaft 39*a* which is projected upward from the top of the motor 39. This first fan 40 is provided with upper and lower sucking openings 41*a* and 41*b*** at the top and bottom thereof and it is enclosed by a casing 43 which has a blowing opening 42 communicated with the cooled air blowing grille 36.

A grille 44 through which heat exchanging air is sucked is arranged on the rear side of the machine chamber 34 and a heat exchanger 45 of the air cooling type which serves as the condenser for the cooling cycle is located in opposite to the air sucking grille 44. The heat exchanger 45 is of the so-called finned tube type and it is tilted under the evaporator 38 with the partition wall 32 interposed between them. The heat exchanging air sucking grille 44 is located under the sucking grille 37 with a certain interval interposed between them and adjacent to an opening 200*a* of the air passage 200. An air filter 46 is detachably attached to the rear side of the body 30, interposing between the sucking grille 37 and the evaporator 38 and between the heat exchanging air sucking grille 44 and the heat exchanger 45 of the air cooling type.

The heat exchanger 45 of the air cooling type is supported on a casing 47, which is provided with upper and lower sucking openings 48 and 49 through which the rotating shaft 39*b* projected downward from the motor 39 is passed. The casing 47 encloses a second fan 50 attached to the rotating shaft 39*b*. A blowing opening 51 of the casing 47 is introduced into an opening 52 which is opened at the rear side of the body 30.

A flexible exhausting hose (not shown) is connected to the blowing opening 51 of the casing 47 and another end of the hose is connected to an exhausting opening which is communicated outside through a wall of the room in which heat exchange is conducted. As the exhausting hose is flexible, the body 30 can be carried to any optional position in the room and all of heat exchanging air taken into the machine chamber 34 can be exhausted outside the room.

A heat exchanger 53 which serves as the condenser for the cooling cycle, land a sprinkler means 54 are arranged under the casing 47. The condenser comprises heat exchangers 45 and 53 of the air and water cooling types. The heat exchanger 53 of the water cooling type is a heat exchanging pipe coiled in double, and it is housed in a cover 55 which is a component of the sprinkler means 54. This sprinkler cover 55 is opened at the top thereof and communicated with the lower sucking opening 49 of the casing 47. The sprinkler cover 55 is also opened at the bottom thereof and the heat exchanger 53 of the water cooling type is projected downward through the opened bottom of the sprinkler cover 55. The lower portion of the heat exchanger 53 is immersed in water in a water tray 56. The lower circumference of the sprinkler cover 55 enters into the water tray 56 with a certain interval interposed relative to the lower circumference of the water tray 56. Further, the lower end of the sprinkler cover 55 is not immersed in the water in the water tray 56 but separated from the level of the water in the water tray 56 by a certain distance. A float switch 57 is located on one side of the water tray 56 to detect the lowest level of the water in the water tray 56.

A sprinkler 58 is fitted onto an end of the rotating shaft 39*b* which is projected from the second fan 50, extending into the sprinkler cover 55 through the lower sucking opening 49 of the casing 47. The sprinkler 58 is enclosed by the heat exchanger 53 of the water cooling type. The sprinkler 58 is a cylinder closed at the top thereof but opened at the bottom thereof and this cylinder is tapered in such a way that its diameter becomes gradually smaller from its top to its bottom. A vane 58*a* is attached integral to the outer circumferential center portion of the sprinkler 58 and a circular sprinkling hole 58*b* is formed adjacent to the vane 58*b*. Further, plural sprinkling windows 58*c* which are slits are formed adjacent to the upper end of the sprinkler 58.

An auxiliary sucking opening 201*a* is arranged at that lower portion of the rear side of the machine chamber 34 which is adjacent to the above-described sprinkler means 54.

Figure 3:
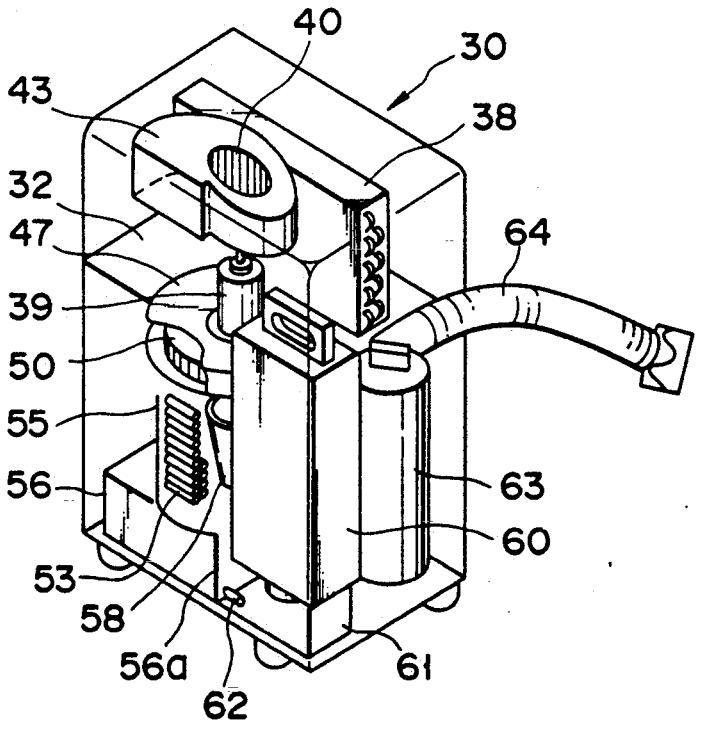
FIG. 3 is a perspective view showing an internal arrangement in the air conditioner.

As shown in FIG. 3, a part of the water tray 56 is extended sideward from a partition plate 56*a* to form a water supply section 61 which receives water supplied from a water tank 60. The partition plate 56*a* is provided with a communicating pipe 62, through which an amount of water equal to that of water used and evaporated on the side of the sprinkler 58 is added from the water tank 60 to the side of the sprinkler 58 via the water supply section 61.

The water tank 60 is freely detachable from the body 30, locating by the sprinkler cover 55 and the casing 47. Further, a compressor 63 is located side by side with the water tank 60. Reference numeral 64 in FIG. 3 denotes a flexible exhausting hose connected o the blowing opening 51 of the casing 47.

Figure 2:
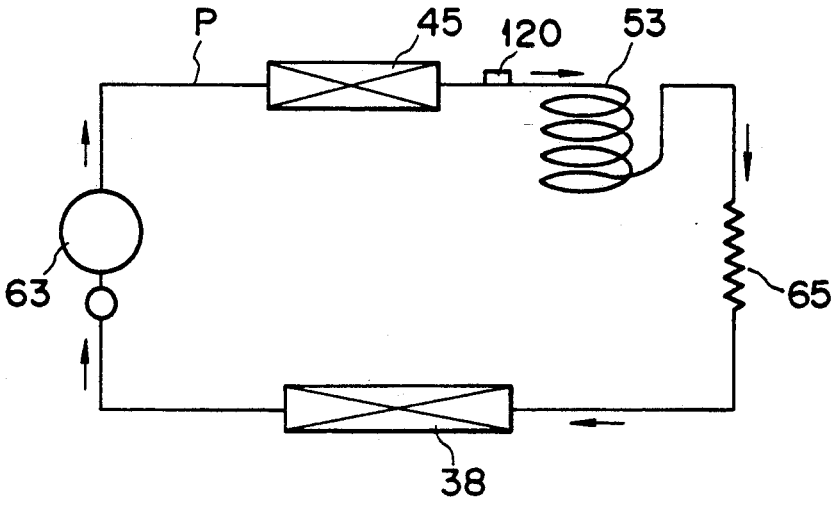
FIG. 2 is a circuit diagram showing a cooling circuit for use with the air conditioner.

As shown in FIG. 2, the heat exchanger 45 of the air cooling type is connected to the discharge side of the compressor 63 through a coolant pipe P, and the heat exchanger 53 of the water cooling type is then located downstream the heat exchanger 45. The heat exchanger 53 is further connected to the sucking side of the compressor 63 through a capillary tube 65 and the evaporator 38. A cooling circuit or cycle is thus formed. Reference numeral 120 represents a high pressure switch arranged between the heat exchangers 45 and 53 to detect coolant pressure in the coolant pipe P.

Figure 4:
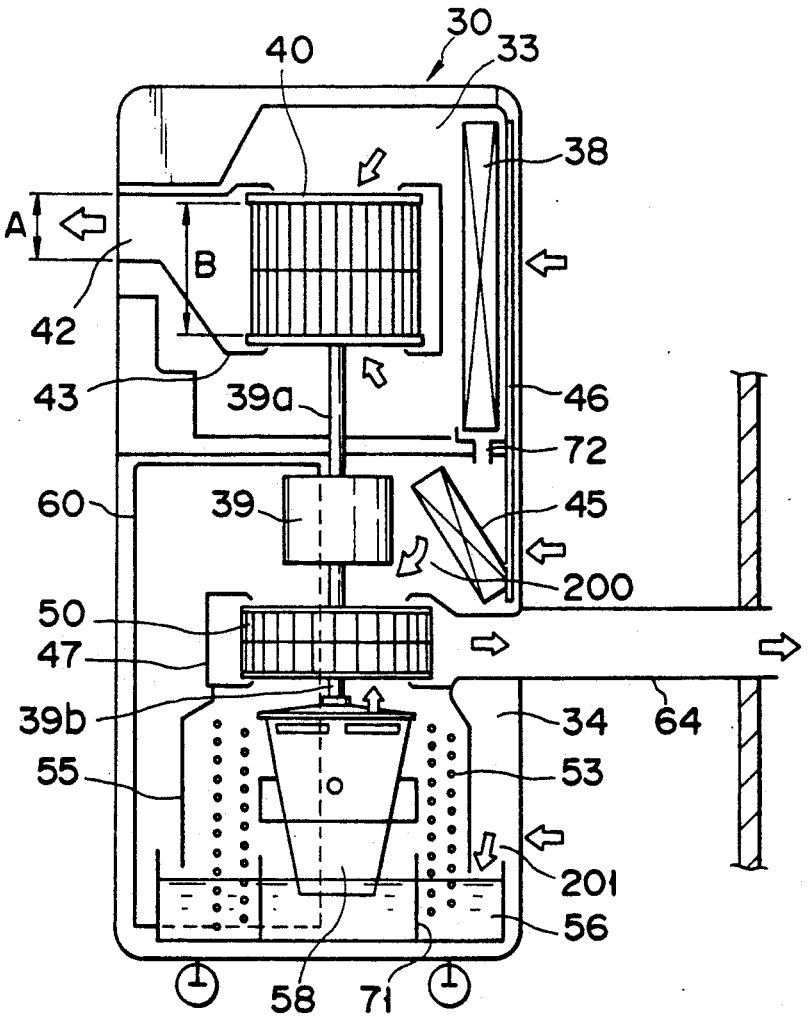
FIGS. 4 and 5 are side and plan views showing casings for enclosing fans in the air conditioner.
Figure 5:
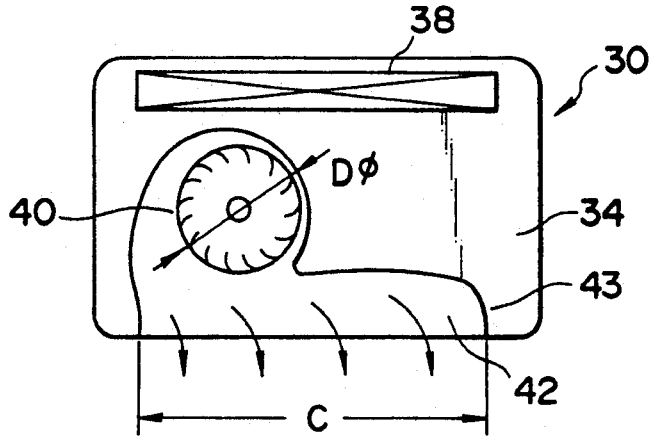

As shown in FIGS. 4 and 5, the vertical dimension A of the blowing opening 42 in the case of the casing 43 which encloses the first fan 40 is made smaller than the longitudinal dimension B of a blade of the first fan 40. The traverse dimension C of the blowing opening 42 may be made substantially wider than the diameter D of the first fan 40 but a little narrower than the front width of the body 30.

Figure 6:
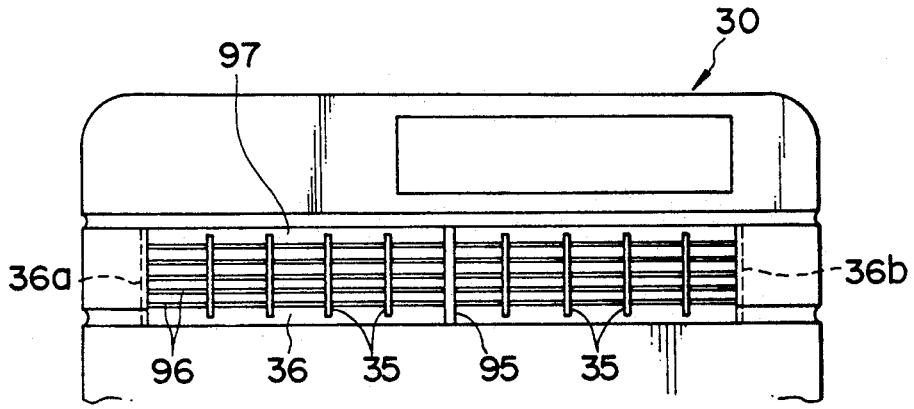
FIG. 6 is a front view showing a grille through which cooling lair is blown out.

As shown in FIG. 6, the cooled air blowing grille 36 is divided into right and left by a partition plate 95 which is located at the center of the grille 36 in the width direction thereof. Plural pieces of the louvers 35 are held, freely swingable sideways, in the grille 36 with a certain interval interposed between them in the width direction of the grille 36. The louvers 35 arranged right and left the partition plate 95 are associated with one another to move in the same direction. A fan guard 97 comprising plural wires 96 covers the cooled air blowing grille 36, extending in the traverse direction of the grille 36 and passing through all of the louvers 35 and the partition plate 95. The wires 96 are arranged in the grille 36 with an extremely narrow interval interposed between them in the vertical direction of the grille 36, thereby preventing any matter from entering into the body 30 through the grille 36.

Figure 7:
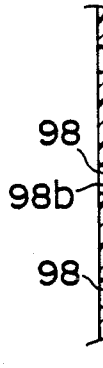
FIG. 7 is a sectional view showing the left side wall of the grille through which cooling air is blown out.

As shown in FIG. 7, the one side wall 36*a* of the cooled air blowing grille 36 is provided with plural wire fixing holes 98 which are arranged to have a certain interval between them in the vertical direction of the grille 36. Each of the wire fixing holes 98 comprises a tapered section 98*a* which has a diameter large enough to allow the wire 96 to pass therethrough and whose diameter becomes gradually smaller as it comes from the inside nearer to the outside of the wall 36*a*, and a hole section 98*b* which extends outward from the bottom of the tapered section 98*a*, having such a diameter that allows the wire 96 to be fitted thereinto.

Figure 8:
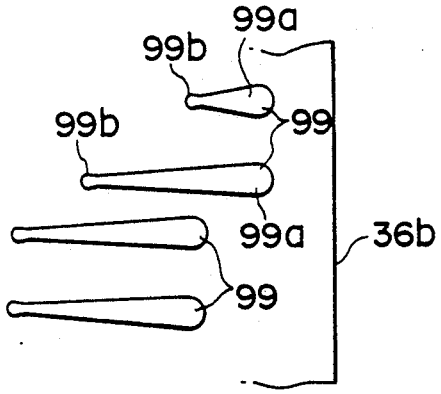
FIG. 8 partly shows the right side wall of the grille through which cooling air is blown out.

As shown in FIG. 8, the other side wall 36*b* of the cooled air blowing grille 36 is provided with plural wire inserting holes 99 which have a certain interval between them in the vertical direction of the grille 36. Each of the wire inserting holes 99 is elongated in the horizontal direction and its one end 99*a* has a radius of curvature large enough to allow the wire 96 to be smoothly passed therethrough while its other end 99*b* has such a radius of curvature that allows the wire 96 to be tightly fitted thereinto. Therefore, the vertical width of each of the wire inserting holes 99 becomes smaller from the large curvature radius end 99*a* to the small curvature radius end 99*b* and it is made a little smaller than the diameter of the wire 96 just before the small curvature radius end 99*b*.

The paired upper and lower wire inserting holes 99 are aligned with each other in the vertical direction at their large curvature ends 99*a* and they are also aligned or not aligned with each other in the vertical direction at their small curvature ends 99*b* , depending upon where they are located in the side wall 36*b* in the vertical direction.

Figure 9:
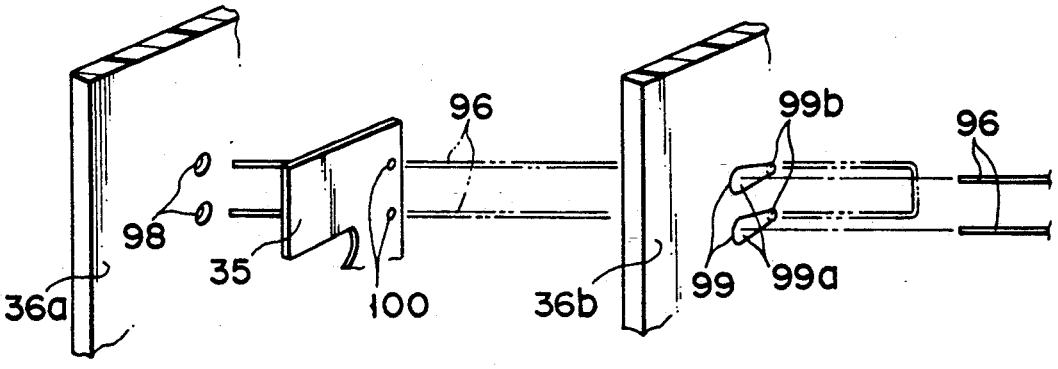
FIG. 9 is a perspective view showing the grille dismantled.

As shown in FIG. 9, the wire 96 which is bent in a fallen U extends in the traverse direction along the whole length of the grille 36. More specifically, both ends of the wire 96 are inserted into the paired upper and lower wire inserting holes 99, passing at first 99. They are then passed through paired upper and lower holes 100 of each of the louvers 35 and inserted into the paired upper and lower wire fixing holes 98, that is, into the hole sections 99*b* through the tapered sections 98*a*. Those both ends of the wire 96 which are projected outside from the wire fixing holes 98 are appropriately fixed to the side wall 36*a* with the U-shaped portion of the wire 96 struck against the side wall 36*b* of the grille 36. The wire 96 thus arranged is then shifted in the wire inserting holes 99 from the large curvature radius ends 99*a* to the small curvature radius ends 99*b*. When it is on the way of its being shifted in this manner, it is forcedly pushed through those portions of the holes 99 whose vertical width is smaller than the diameter of the wire and then fixedly seated in the small curvature radius ends 99*b* of the holes 99.

As described above, the cooled air blowing grille 36 is provided with the fan guard 97 which comprises the plural wires 96. This enables any matter to be prevented from entering into the body 30. Further, the side wall 36*a* of the grille 36 is provided with the wire fixing holes 98 each comprising the tapered section 98*a* and the hole section 98*b*, so that each of the wires 96 can be inserted into the holes 98 and then fixed to the side wall 36*a* with higher reliability.

Still further, each of the wires 96 can be more easily inserted into the paired upper and lower wire inserting holes 99 in the side wall 36*b* of the grille 36 because its both ends are passed at first through the large curvature radius ends 99*a* of the holes 99. In addition, the vertical width of each of the holes 99 is made a little smaller than the diameter of the wire 96 just before the small curvature radius end 99*b*. Therefore, the wire 96 is forcedly pushed through this portion of the hole 99 while it is being shifted from the end 99*a* to the other end 99*b* of the hole 99, and then fixedly seated in the small curvature radius end 99*b*, so that it can be fixedly held in the end 99*b* with higher reliability while its movement in the hole 99 is being prevented by that portion of the hole 99 whose vertical width is a little smaller than the diameter of the wire 96.

Figure 10:
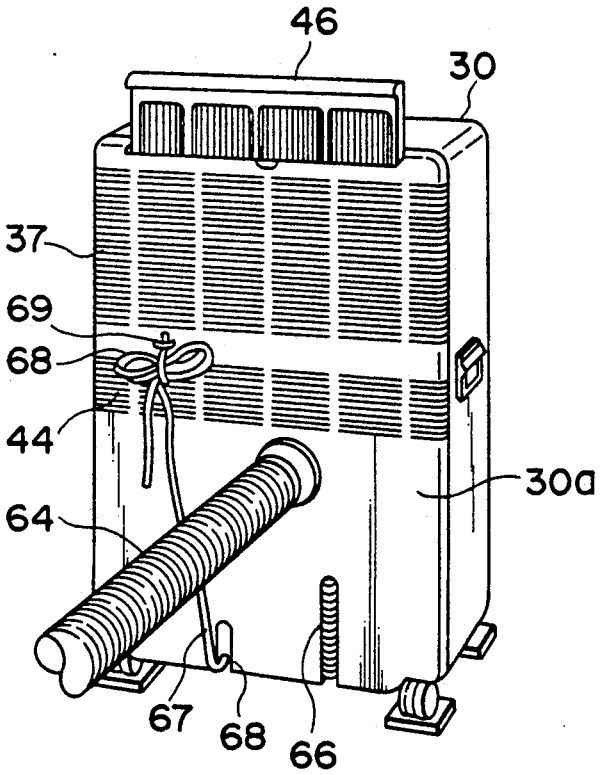
FIG. 10 is a perspective view showing the rear side of the air conditioner from which the air filter is pulled.

As shown in FIG. 10, a rear side panel 30*a* is freely detachably attached to the back of the air conditioner body 30 and it includes the sucking grille 37 and the heat exchanging air sucking grille 44 which are separated from each other by a certain distance in the vertical direction. The air filter 46 is freely detachably inserted into the body 30 inside the panel 30*a*, facing the grilles 37 and 44.

Figure 11:
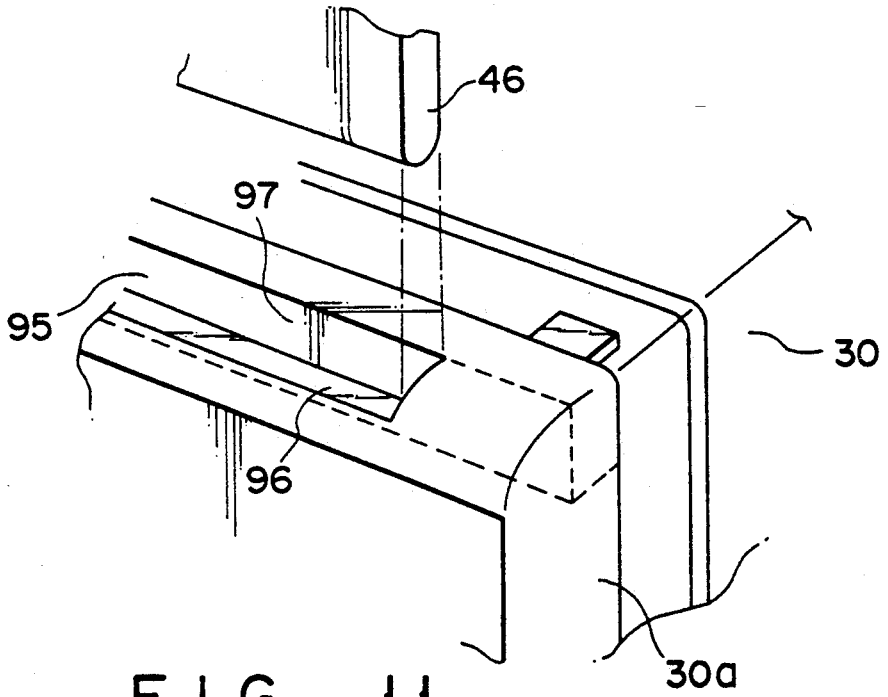
FIG. 11 is a perspective view showing a part of that portion of the air conditioner into which the air filter is fitted.
Figure 12:
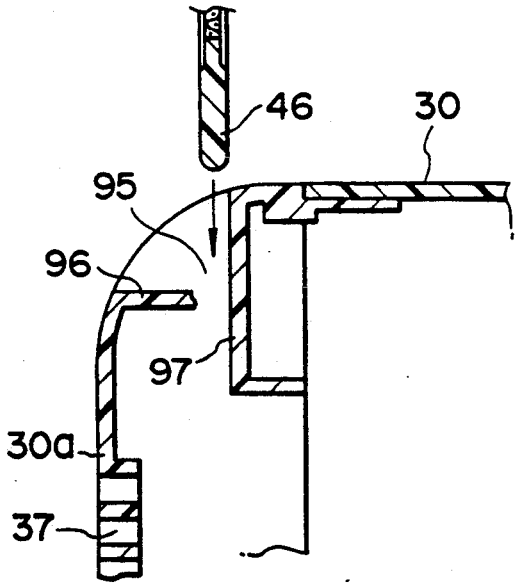
FIGS. 12 and 13 are vertically-sectioned views showing that portion of the air conditioner into which the air filter is fitted.
Figure 13:
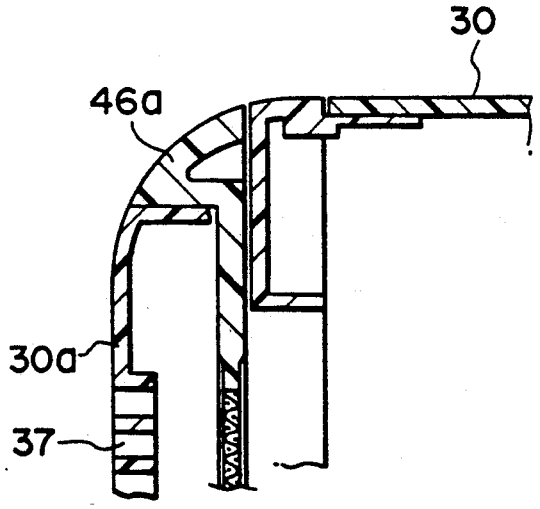

As shown in FIGS. 11 through 13, the top of the rear side panel 30*a* is curved and a slit 95 through which the air filter 46 is inserted into the body 30 is formed at a part of the curved top of the rear side panel 30*a*. The air filter inserting slit 95 extends in the width direction of the rear side panel 30*a*, leaving its both ends separated from those of the rear side panel 30*a* by a certain distance. A horizontal flange 96 extends from the top of the front side of the slit 95 while the rear side thereof extends downward in the vertical direction to form a guide face 97. The air filter inserting slit 95 is formed between the flange 96 and the guide face 97.

The air filter 46 has such thickness and width that allow it to be freely detachably inserted into the slit 95, and it has at the upper portion thereof a hook 46*a* which is hooked on the flange 96.

As shown in FIG. 10, the exhausting hose 64 extends from the substantially center portion of the rear side panel 30*a* and from under the heat exchanging air sucking grille 44. The rear side panel 30*a* includes adjacent to its bottom a drain hose housing section 66 and a cutaway portion 68 through which a power source cord 67 extending from a power source section (not shown) in the body 30 is passed. A projection 69 on which a cord grip 68 for holding the power source cord 67 as a bundle is hooked is formed integral to the rear side panel 30*a* between the grilles 37 and 44.

Figure 15:
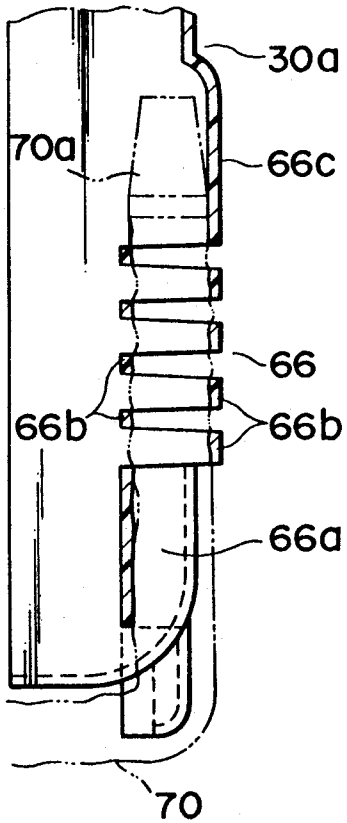
FIG. 15 is a sectional view taken along a line I–I in FIG. 14.
Figure 14:
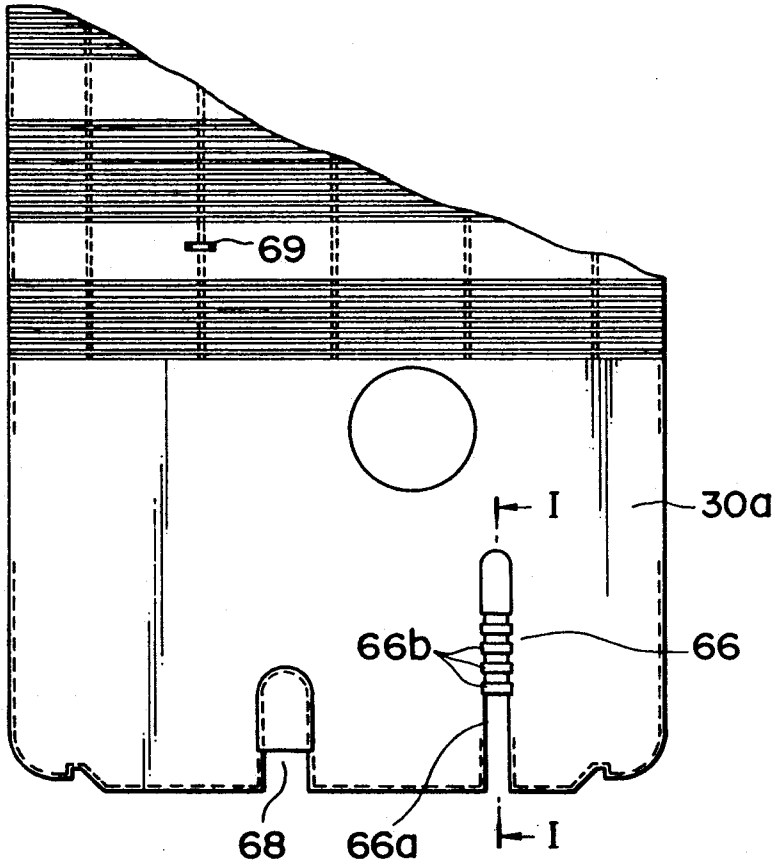
FIG. 14 is a rear side view showing that portion of the air conditioner in which the drain hose is housed.

As shown in FIGS. 14 and 15, a cut-away portion 66*a*is formed at the drain hose housing section 66, extending upward from the bottom of the rear side panel 30*a* to a certain height, and plural curved pieces 66*b* are then piled upward one upon the other, projecting alternately forward and backward. Each of the curved pieces 66*b* is made semi-circular and the adjacent ones form a true circle when they are combined with each other. The diameter of this circle is made a little larger than that of an open front end portion 70*a* of a drain hose 70 connected to the water tray 56. That portion which extends upward from the uppermost curved piece 66*b* is swelled outward to form a swelled portion 66*c*.

Figure 16:
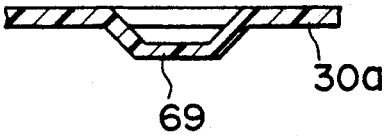
FIGS. 16 and 17 are sectional and perspective views showing a hook of the air conditioner to which the power cord is hooked.
Figure 17:
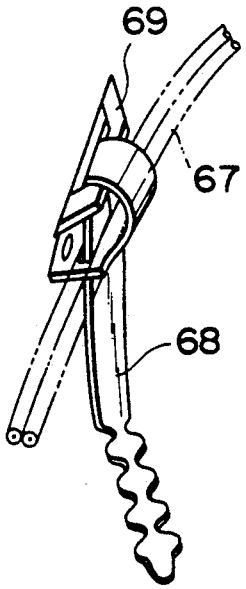

As shown in FIG. 16, the hooked projection 69 is formed by projecting outward a part of the rear side panel 30*a* like a mountain and the top of the projections is parallel to the rear side panel 30*a*. The projection has such width and height that allow the cord grip 68 to be inserted into it. As shown in FIG. 17, the cord grip 68 is held by the hooked projection 69 while a part of it is being inserted into the projection 69, and the bundled power source cord 67 is then hooked by the cord grip 68.

Figure 18:
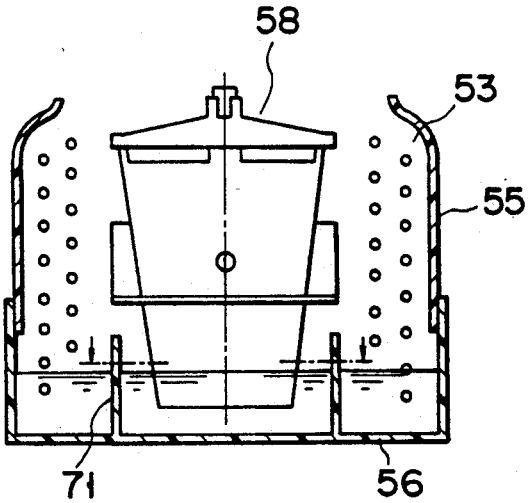
FIG. 18 is a vertically-sectioned view showing water sprinkler and tray in the air conditioner.
Figure 19:
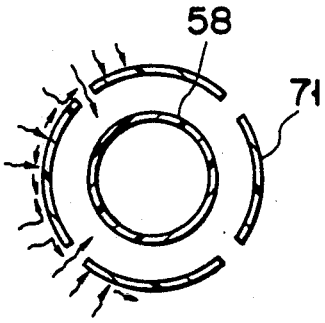
FIG. 19 is a traversely-sectioned view showing the water tray.

As shown in FIGS. 18 and 19, a rib 71 is formed integral to the water tray 56. The rib 7 comprises plural pieces located on a circle concentric to the sprinkler 58, separated from the outer circumference of the sprinkler 58 by a certain distance and also separated from the adjacent ones by a certain distance. The height of the rib 71 must be made larger than the surface level of water collected in the water tray 56.

Figure 20:
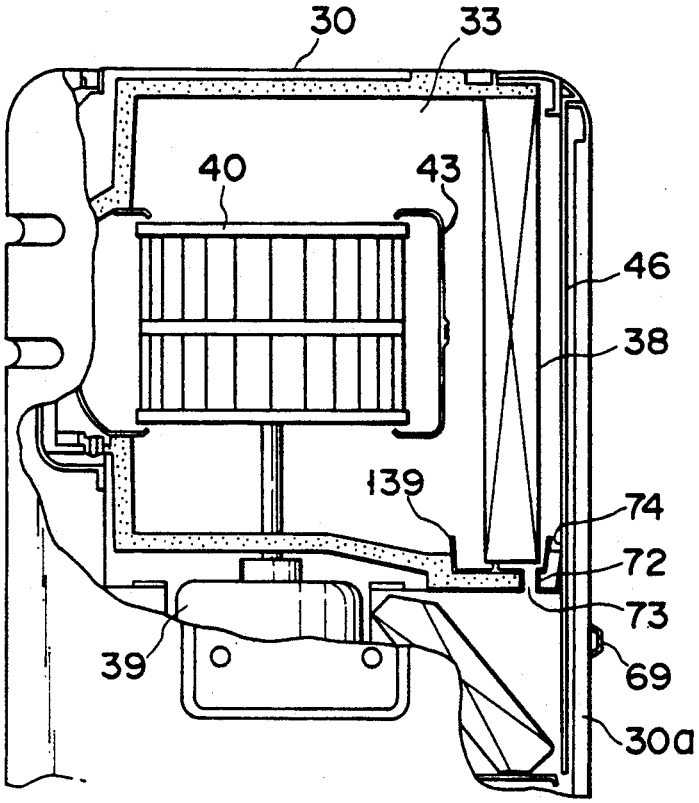
FIG. 20 is a partly-sectioned view showing a cooling chamber in the air conditioner.
Figure 21:
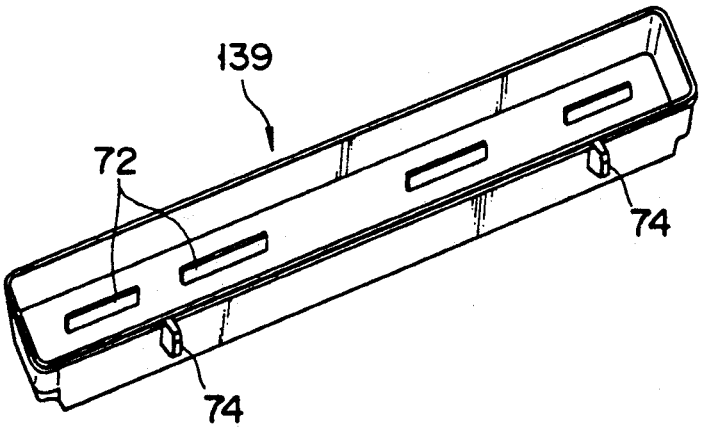
FIG. 21 is a perspective view showing a drain pan.

As shown in FIGS. 20 and 21, plural drain water discharging openings 72 are formed at the bottom of the drain pan 139 arranged under the evaporator 38, and they are communicated with the hole 73 of the partition wall 32. One end of a hose (not shown) is connected to the communicating hole 73 while the other end thereof is connected to the water tray 56. All of drain water created by the evaporator 38 is thus introduced into the water tray 56. A pair of air filter guides 74 are formed on the rear side of the drain pan 139. These air filter guides 74 are projected so that both sides of the air filter may be struck against them when the air filter 46 are inserted into the body 30 inside the rear side panel 30*a*.

Figure 22:
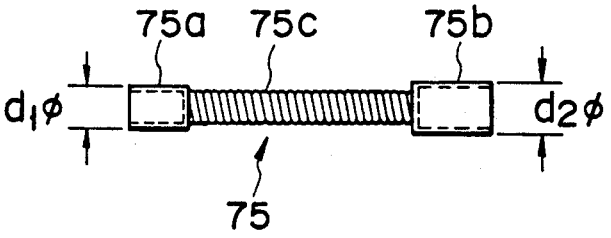
FIG. 22 is a side view showing a water supply hose.

As shown in FIG. 22, the air conditioner of the present invention has a water supply hose 75 through which water is supplied to the water tank 60. The water supply hose 75 includes cylindrical couplings 75*a* and 75*b*, and an expansive flexible hose section 75*c* which connects the couplings 75*a* and 75*b* to each other. The diameter $d_10$ of the coupling 75*a* is made smaller than that $d_20$ of the other coupling 75*b* and the coupling 75*a* can be thus detachably fitted into the coupling 75*b*.

Figure 23:
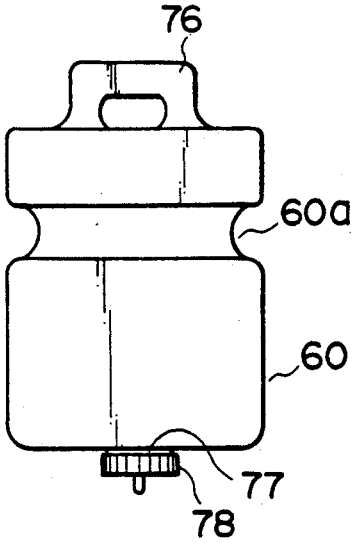
FIG. 23 is a side view showing a water tank.

As shown in FIG. 23, a hose holder recess 60*a*, semicircular in section, is formed round the outer circumference of the water tank 60 and the curvature radius of this hose holder recess 60*a* is about same as that of the coupling 75*b*. A grip 76 is formed on the top of the water tank 60 while a water supply opening 77 is projected from the underside of the water tank 60. A cap 78 provided with a valve system is screwed onto the water supply opening 77.

Figure 24:
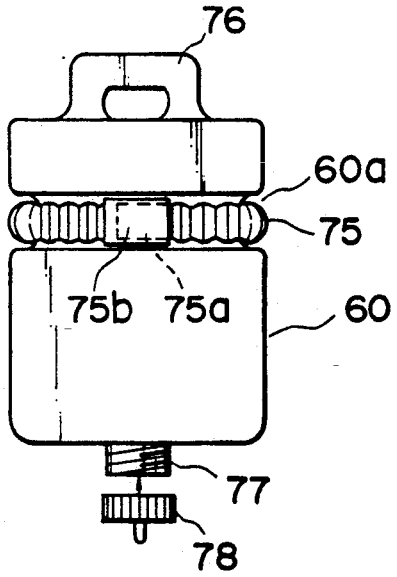
FIG. 24 is a side view showing the water tank provided with the water supply hose.

FIG. 24 shows the water supply hose 75 held in the hose holder recess 60*a* of the water tank 60. The hose section 75*c* of the water supply hose 75 is expanded to some extent and the coupling 75*a* is fitted into the other coupling 75*b*. The water supply hose 75 is thus wound round the water tank 60 in the hose holder recess 60*a*.

Figure 25:
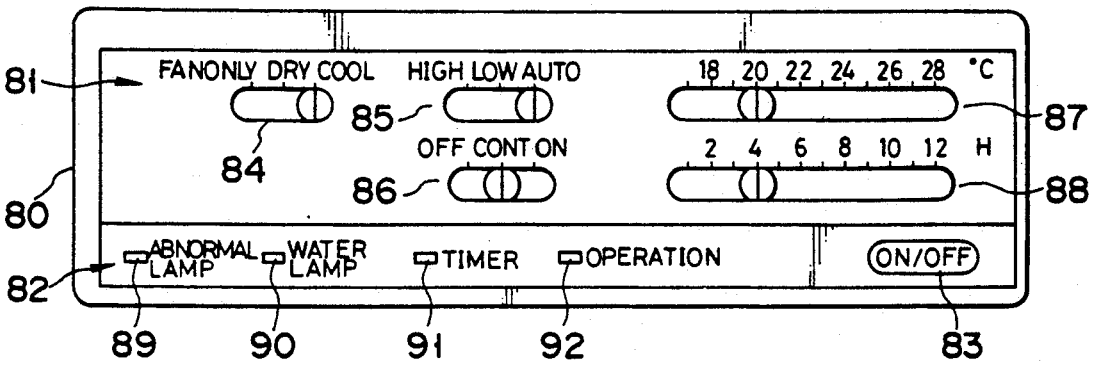
FIG. 25 is a front view showing an operation panel of the air conditioner.

As shown in FIG. 25, an operation panel 80 is arranged on a part of the front side of the body 30. Switches 81 are arranged on the upper portion of the operation panel 80 and lamps 82 and a power switch 83 are arranged on the lower portion thereof. Fan, dry or cool can be selected by an operation mode switch 84 of the switches 81. High, low or automatic can be selected by a changeover switch 85 to adjust the amount of air blown by the first fan 40. "Continued", "switched on after the lapse of a set time" or "switched off after the lapse of a set time" can be selected by a timer switch 86. Any optional cooling temperature can be set in a range of predetermined temperatures by a temperature set switch 87. Any optional time can be set in a range of predetermined times by a timer switch 88. An abnormal lamp 89 of the lamps 82 is lit only when something wrong such as abnormal rise of pressure and failure of water supply occurs. Lamp 90 is lit only when the float switch 57 detects that the surface level of water in the water tray 56 is lower than a predetermined level. A timer lamp 91 is lit when the timer is under operation. An operation lamp 92 is lit when the power switch 83 is switched on.

Figure 26:
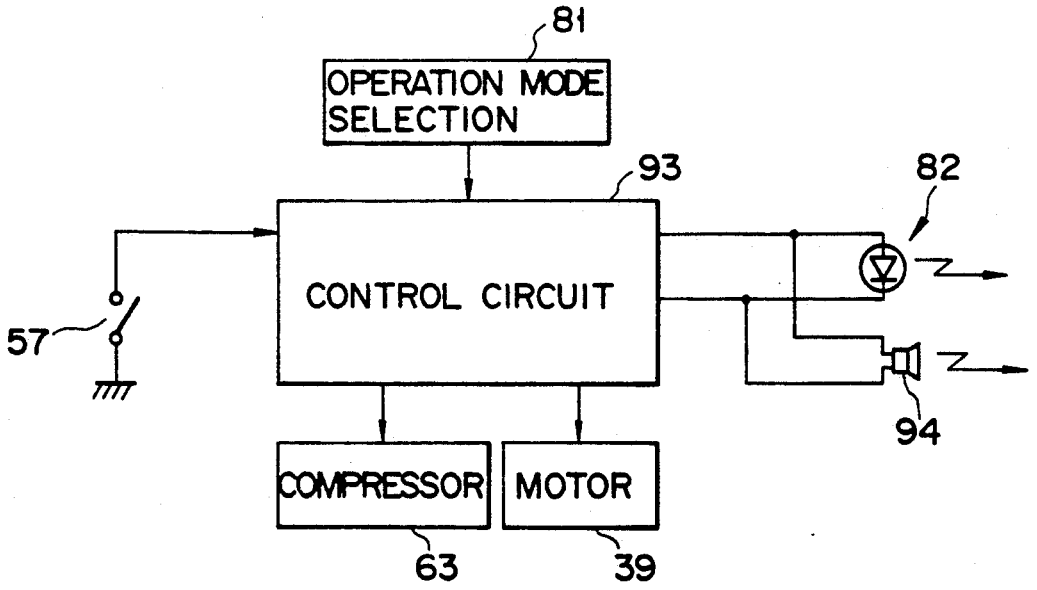
FIG. 26 is a block diagram showing an electric circuit for use with the air conditioner.

As shown in FIG. 26, a control circuit 93 which comprises a micro-computer for the air conditioner is electrically connected to the switches 81 and the lamps 82 on the operation panel 80, the float switch 57 in the water tray 56, the compressor 63 which forms the cooling cycle, the motor 39 and an alarm buzzer 94.

The operation of the air conditioner which is arranged as described above will be described.

As shown in FIGS. 1 through 4, the compressor 63 is driven to compress the coolant and blow it under high temperature and pressure. At the same time the motor 39 is switched on to simultaneously drive the first and second fans 40 and 50 and the sprinkler 58. The coolant is introduced from the heat exchanger 45 of the air cooling type into the heat exchanger 53 of the water cooling type where it is condensed while exchanging heat. It is further introduced into the capillary tube 65 to reduce its pressure and then into the evaporator 38 where it is evaporated. Heat exchanging air in the room which is to be cooled has been introduced into the evaporator 38 and it exchanges heat with the coolant so that the latent heat of vaporization can be taken from it. Its temperature is thus lowered to create cooled air, which is again blown into the room. The cooling of the room is thus conducted.

On the other hand, the first fan 40 takes heat exchanging air into the cooling chamber 33 through the sucking grille 37. This heat exchanging air is filtered by the air filter 46 and passed through the evaporator 38 while it is exchanging heat with the coolant to become cooled air after the latent heat of vaporization is taken off from it. The cooled air is sucked into the first fan 40 through the upper and lower openings 41*a* and 41*b* of the casing 43 and again blown into the room through the opening 42 of the casing 43 and the cooled air blowing grille 36.

According to the embodiment of the present invention, the vertical dimension A of the opening 42 of the casing 43 is made smaller than the longitudinal dimension B of the blade of the first fan 40 and the traverse dimension C thereof is made considerably larger than the diameter $D\phi$ of the first fan 40, that is, substantially close to the traverse dimension of the front side of the body 30, as shown in FIGS. 4 and 5. Therefore, the cooled air blown by the first fan 40 gradually raises its static pressure while it flows from the fan 40 to the blowing opening 42. Its flow is thus scattered in the traverse direction. In fact, the speed of its flow is averaged by the time when it is blown outside through the blowing opening 42, and it can be uniformly blown out into the room while its amount blown out through the cooled air blowing grille 36 is being averaged in the traverse direction of the grille 36.

As shown in FIGS. 1 through 4, the second fan 50 is driven together with the first fan 40 to take heat exchanging air into the machine chamber 34 through the heat exchanging air sucking grille 44. The heat exchanging air is filtered at this time by the air filter 46 to thereby keep the heat exchanger 45 of the air cooling type clean. The heat exchanger 4 of the air cooling type is located adjacent to the evaporator 38 with the partition wall 32 interposed between them. This enables the air filter 46 to filter both of the room air introduced to the evaporator 38 and the heat exchanging air introduced to the heat exchanger 45 of the air cooling type. In addition, the partition wall 32 interposed between the evaporator 38 and the heat exchanger 45 enables both of the evaporator 38 and the heat exchanger 45 to conduct heat exchange independently of the other. The heat exchanger 45 of the air cooling type is tilted. Therefore, a sufficient amount of heat exchanging air can be obtained even if the vertical dimension of the heat exchanging air sucking grille 44 is made small.

Except when the air conditioner is started, the heat exchanger 45 of the air cooling type exchanges heat with the heat exchanging air, relatively low in temperature and humidity, in the room which has been already cooled. Therefore, temperature difference between the coolant and the air introduced to the heat exchanger 45 is so large that the efficiency of heat exchange can be made large.

The air which has been passed through the heat exchanger 45 of the air cooling type to exchange heat is introduced into the casing 47 through the upper sucking opening 48 of the casing 47 and exhausted outside the room through the opening 51 and the exhausting hose 64.

The air in the room is also sucked into the machine chamber 34 through the auxiliary sucking grille 59 and introduced into the sprinkler cover 55, passing between the lower outer circumference of the sprinkler cover 55 and the upper inner circumference of the water tray 56, due to the operation of the second fan 50. The heat exchanging air exchanges heat with the heat exchanger 53 of the water cooling type in the sprinkler cover 55. It is then introduced into the casing 47 through the lower sucking opening 49 of the casing 47 and combined with the air which has exchanged heat with the heat exchanger 45 of the air cooling type to be exhausted outside the room through the exhausting hose 64.

The sprinkler 58 is rotated by the motor 39 to suck up water in the water tray 56 along its inner circumference through its bottom opening due to its centrifugal force. The water which has reached the sprinkling hole and windows **58*b* and 58*c* is sprinkled, flying out through the hole and windows 58*b* and 58*c*. The heat exchanger 53 of the water cooling type receives directly drops of water sprinkled by the sprinkler 58 or indirectly drops of water once struck against and splashed by the sprinkler cover 55. Or drops of water dropped on the top of the coiled tube of the heat exchanger 53 flow downward along the bottom of the tube. The blade 58*a* attached to the outer circumference of the sprinkler 58 stirs up the air in the sprinkler cover 55 while it is being rotated, to thereby assist the air in exchanging heat with the heat exchanger 53. At the same time, it receives drops of water struck against and splashed by the heat exchanger 53 to again sprinkle them on the heat exchanger 53**.

The heat exchanger 53 of the water cooling type sufficiently undertakes the water sprinkling operation of the sprinkler 58, thereby enabling the coolant and the water introduced to the heat exchanger 53 to exchange heat with each other. Most of the water drops which have drenched the heat exchanger 53 falls into the water tray 56 and it is again sprinkled y the sprinkler 58. A part of the water drops is vaporized and mixed with the air which has been introduced into the sprinkler cover 55 and exchanged heat with the heat exchanger 53 to become air of high humidity. This high humid air is introduced into the casing 47 through the lower sucking opening 49 of the casing 47 and mixed with the heat exchanging air which has been sucked through the upper sucking opening 48 and exchanged heat with the heat exchanger 45 of the air cooling type. The high humid air introduced from the sprinkler cover 55 exchanges heat with the heat exchanger 45 of the air cooling type while it is being heated to air of relatively high temperature. This air is changed to air of low humidity on the way of its being introduced from the second fan 50 to the exhausting hose 64 and it is exhausted outside through the hose 64. This prevents water drops from adhering to the second fan 50 and the exhausting hose 64.

As shown in FIG. 1, therefore, a first air passage 200 extending from the heat exchanging air sucking grille 44 to the exhausting hose 64 through the heat exchanger 45 of the air cooling type, upper sucking opening 48, second fan 50 and blowing opening 51 is formed in the machine chamber 34 along with a second air passage 201 extending from the auxiliary sucking grille to the exhausting hose 64 through the sprinkler cover 55, lower sucking opening 49, second fan 50 and blowing opening 51. The heat exchanger 45 of the air cooling type is located on the sucking side of the first air passage 200 and the heat exchanger 53 of the water cooling type on the sucking side of the second air passage 201. No water drop sprinkled by the sprinkler 58 adheres to the heat exchanger 45 of the air cooling type. There- fore, the heat exchanger 45 is neither eroded nor jammed with water drops, thereby enabling the heat exchange to be attained with a higher reliability. The heat exchanger of the water cooling type is bathed in water sprinkled by the sprinkler 58 and also contacted with the hat exchanging air introduced through the second air passage 201. This also enables the heat exchange to be achieved with a higher reliability. An amount Q of heat exchanged on this high pressure side can be expressed as follows:

$$Q = Q_1 + Q_2$$

$$Q_1 = Kc\,(Tc - Ta)$$

$$Q_2 = Cu \cdot G$$

wherein $Q_1$ represents an amount of heat exchanged by the heat exchanger 45, $Q_2$ an amount of heat exchanged by the heat exchanger 53, Kc a rate of heat (Kcal/h·° C.) exchanged by the heat exchanger 45, Tc an average temperature (° C.) of the coolant in the heat exchanger 45, Ta a temperature (° C.) of air sucked into the heat exchanger 45, Cu a latent heat (Kcal/Kg) of water and G an amount (Kg/h) of water consumed.

Providing that the amount Q of heat exchanged on the high pressure side is certain. Tc−Ta becomes large and $Q_1$ is increased when the heat exchanger 45 of the air cooling type is located in the air passage 200 different from that of the heat exchanger 53 of the water cooling type. $Q_2$ becomes small instead, while keeping Cu certain. G is thus decreased. Namely, the amount of water consumed is reduced to a greater extent, the time period during which the air conditioner can be continuously operated is made considerably longer and the interval during which no water may be added into the water tank 60 is made longer. The labor of adding water into the water tank 60 can be thus saved.

The air conditioner of the present invention has the following characteristics:

As shown in FIGS. 11 through 13, the air filter 46 is inserted into and pulled out of the slit 95 on the top of the rear side panel **30*a*. When the air filter 4 is to be located inside the rear side panel 30*a*, it may be dropped into the slit 95 while keeping its lower end portion inserted into the slit 95. It is guided by the guide face 97 at this time. And when the hook 46*a* at its top is hooked on the flange 96 on the top of the rear side panel 30*a*, the process of locating it inside the rear side panel 30*a*** is finished.

When the top of the air filter 46 is shaped to match the curved top of the rear side panel 30*a* and colored in same color as that of the top of the rear side panel 30*a*, it can seem to merge into the top of the rear side panel 30*a*.

The air filter 46 can be smoothly pulled out of the slit 95 on the top of the rear side panel 30*a* because it is guided by the guide face 97.

The slit 95 is formed on the top of the rear side panel 30*a* as described above. Therefore, that portion of the rear side panel 30*a* which is attached to the body 30 can be freely selected and its rigidity can be thus enhanced, thereby making it unnecessary to divide the air filter 46 into right and left.

As shown in FIGS. 14 and 15, the drain hose 70 connected to the water tray 56 is bent upward at about right angle on the way of it and its front end portion is inserted into the drain hose housing section 66, as shown by two-dot and dash lines, except when water collected in the water tray 56 is to be drained. A part of the water in the water tray 56 can be held in it because the level of its front end opening is made higher than that of the water surface in the water tray 56. In addition, it can be more easily housed in the drain hose housing section 66. The curved pieces 66*b* which form the drain hose housing section 66 are projected alternately forward and backward and each of these curved pieces 66*b* is made substantially semi-circular. And when the curved piece 66*b* projected forward is combined with its adjacent one projected backward, they form a true circle, and the diameter of this true circle is made a little smaller than that of the drain hose 70. This enables the drain hose 70 to be held and housed in the drain hose housing section 66 with a higher reliability. When the drain hose housing section 66 is shaped as described above and the drain hose 70 is colored in same color as that of the rear side panel 30*a*, the drain hose 70 can be hardly viewed from outside, thereby keeping the appearance of the air conditioner fine.

When the water tray 56 is to be cleaned, the drain hose 70 is pulled out of the drain hose housing section 66 and extended outside the rear side panel 30*a*. Because the front end opening of the drain hose 70 is made lower than the bottom of the water tray 56, all of the water in the water tray can be drained. This makes it easier to drain the water in the water tray 56.

As shown in FIGS. 16 and 17, the hooking projection 69 is formed integral to the rear side panel 30*a*. Therefore the cord grip 68 by which the power cord 67 is bundled up can be hooked by the projection 69. Different from the conventional cases where the power cord 67 was left on the floor of the room which was to be cooled, while being bundled up by the cord grip 68, the power cord 67 can be more easily put into order, its safety can be enhanced and it cannot spoil the appearance of the air conditioner.

As shown in FIGS. 18 and 19, the rib 71 formed integral to the water tray 56 encloses the sprinkler 58, its top is made higher than the surface of water in the water tray 56, and it is divided into pieces on the circle concentric with the sprinkler 58 Even when the surface of water in the water tray 56 waves as the sprinkler 58 sucks up the water collected in the water tray 56, therefore, the rib 71 can prevent the surface of water in the water tray 56 from waving. As the result, any noise because of the waving water surface can be neither created nor sounded outside. In addition, the lower portion of the sprinkler 58 inside the rib 71 is kept immersed in the water in the water tray 56. This enables a predetermined amount of water to be sucked up and sprinkled by the sprinkler 58.

As shown in FIGS. 20 and 21, the air filter 46 covers both of the sucking grille 37 located on the side of the evaporator 38 and of the heat exchanging air sucking grille 44 located on the side of the heat exchanger 45 of the air cooling type to thereby filter air sucked through both of them. When the air filter 46 is to be cleaned to prevent it from being jammed by dust, it may be pulled out from inside the rear side panel 30*a* through the slit 95.

When the cleaning of the air filter 46 is finished, the air filter 46 is again inserted inside the rear side panel 30*a* through the slit 95. The lower end portion of the air filter 46 is slidably contacted with and guided by the air filter guides 74 projected from the drain pan 39. In other words, the air filter guides 74 help the air filter 46 be smoothly located inside the rear side panel 30*a*.

When the air filter 46 is located at the predetermined position inside the rear side panel 30*a*, its intermediate portion is pushed against the rear side panel 30*a*. Even when the air conditioner is vibrated under operation, therefore, the air filter 46 is not shaked to thereby prevent any noise from being created.

As shown in FIGS. 22 through 24, the water supply hose 75 is wound round the water tank 60 in the hose holder recess 60*a* and one of the couplings 75*a* and 75*b* is fitted into the other. This enables the housing of the water supply hose 75 to be more easily attained. When water is to be supplied to the water tank 60, one of the couplings 75*a* and 75*b* is pulled out of the other to detach the water supply hose 75 from the water tank 60. The coupling 75*a*, for example, is connected to the water supply opening 77 from which the cap 78 has been detached, while the other coupling 75*b* is connected to the water supply source such as the faucet. The water supply into the water tank 60 can be more easily attained in this manner.

When water in the water tank 60 is consumed as water in the water tray 56 is sprinkled by the sprinkler 58 and when the float switch 57 detects that the surface of water in the water tray 56 is lower than the predetermined value, detection signal is applied to the control circuit 93, as shown in FIGS. 25 and 26. The control circuit 93 then sends signal to the lamp 90 on the operation panel 80 and the lamp 90 is lit or flickered for a certain time period responsive to the signal. Or the alarm buzzer 94 is made operative for a certain time period to inform the user that water in the water tank 60 is used up. Responsive to the lit or flickering lamp 90 or sounding buzzer 94, the user takes the water tank 60 out of the body 30 and detaches the water supply hose 75 from the water tank 60, as shown in FIGS. 22 through 24. Water is supplied into the water tank 60 through the water supply hose 75 and the water tank 60 thus filled with water is then located at the predetermined position in the body 30. It is needed that a series of these processes is quickly done. Because the efficiency of heat exchanged by the heat exchanger 53 of the water cooling type is reduced when the amount of water sprinkled over to the heat exchanger 53 is decreased. This causes the abnormal lamp 89 to be lit and the cooling operation of the air conditioner to be stopped accordingly.

According to the air conditioner of the present invention, water supply into the water tank 60 can be quickly attained, it is not needed that the cooling operation is stopped every time water is supplied to the water tank 60, and temperature in the room is not raised accordingly to keep the room comfortably cooled.

When the timer switch 86 is made operative to set on or off the air conditioner after the lapse of a certain time period, not knowing that the amount of water left in the water tank 60 is quite a little, the lamp 90 is lit before the lapse of the certain time period. If water is supplied to the water tank 60 at once even in this case, the effect of the timer can be kept because the cooling operation of the air conditioner is continued.

Figure 27:
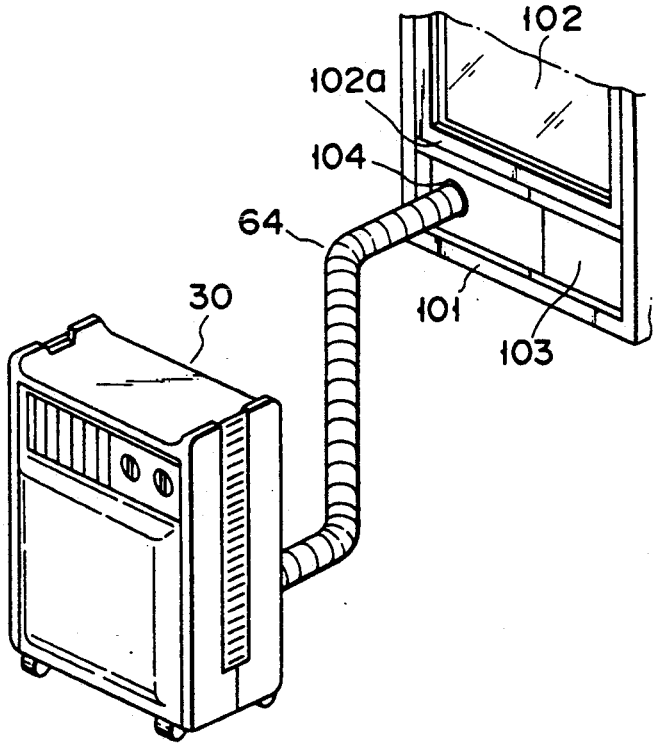
FIG. 27 is a perspective view showing the air conditioner whose exhausting hose is attached to a window frame.

Although the flexible exhausting hose 64 has been fitted into the hole of the wall of the room which is to be cooled in the case of the above-described air conditioner of the present invention, it is not limited to this arrangement but it may be arranged as shown in FIG. 27. A window attachment 103 is fixed between a window frame 101 and a sash 102*a* of a window 102 and the exhausting hose 64 extending from the air conditioner body 30 is fitted into a hole 104 of the window attachment 103.

Figure 28:
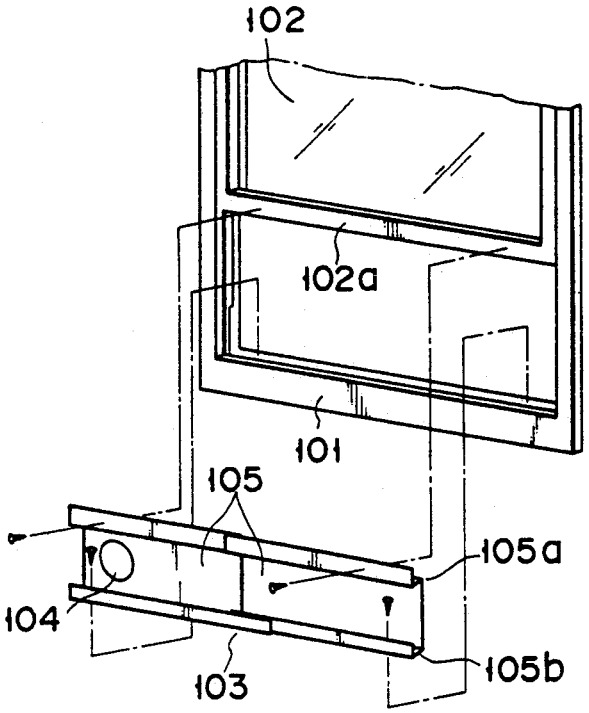
FIG. 28 is a perspective view showing an attachment by which the exhausting hose of the air conditioner is attached to the window frame.

As shown in FIG. 28, the window attachment 103 comprises a pair of right and left attachment plates 105, which can be slid relative to each other to correspond to the traverse dimension of the window frame 101. The upper portion of each of the attachment plates 105*a* is bent like a character L while the lower portion thereof is bent like a character U.

Figure 29:
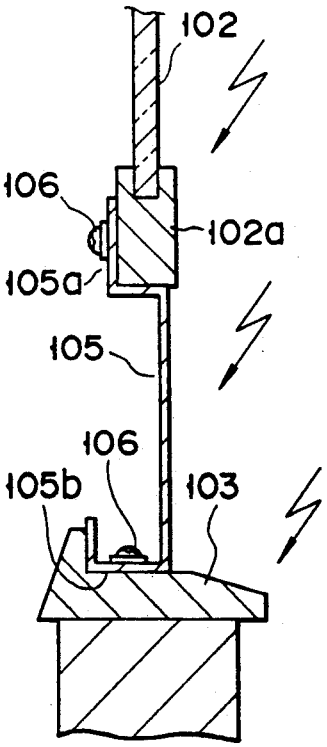
FIG. 29 is a sectional view showing the attachment.

As shown in FIG. 29, the window attachment 10 is attached to the window frame 101 in such a way that its U-shaped lower end 105*b* is mounted on the window frame 103 and fixed there by fixing members 106 such as screws and that the sash 102*a* of the window 102 is mounted on its L-shaped upper end 105*a* and fixed there by fixing members 106 such as screws. Namely, the sash 102*a* of the window 102 is fixed to the window attachment 103, while contacting its side which is directed into the room with the top side of the window attachment 103 and its bottom with the top bottom of the window attachment 103.

Therefore, the sash 102*a* of the window 102 and the window attachment 103 are contacted with each other at their two faces. This enables them to be attached to each other with a higher strength and to prevent rain from entering into the room without using any sealing member between them, thereby enhancing their sealing ability.

It should be understood that the present invention is not limited to the above-described embodiment but that various changes and modifications can be made without departing from the spirit and scope of the present invention.

What is claimed is:

1. An air conditioner comprising:

a compressor having sucking and discharging ports;

a condenser of the air cooling type having an inlet port connected to the discharging port of the compressor, an outlet port, and an air inlet side;

a condenser of the water cooling type having an inlet port connected to the outlet port of the condenser of the air cooling type and an outlet port;

a regulator connected to the outlet port of the condenser of the water cooling type;

an evaporator connected between the regulator and the sucking port of the compressor and having an air inlet side, the evaporator being located adjacent to the condenser of the air cooling type;

two independent air passages each having an opening through which air is taken in, the condensers of the air and water cooling types located adjacent tot he openings of the air passages, respectively; and an air filter detachably arranged to cover the air inlet sides of the air cooling type condenser and the evaporator.

2. The air conditioner according to claim 1, further comprising a drain pan located under the evaporator and having a peripheral wall and air filter guides protruding outward from the peripheral wall, the air filter being positioned by the air filter guides.

3. The air conditioner according to claim 1, further comprising:

a body of the air conditioner;

a motor housed in the body and having a rotating shaft directed in the vertical direction;

a fan of the centrifugal multi-blade type attached to the rotating shaft of the motor; and a casing enclosing the fan and having a sucking opening in the axial direction thereof and a blowing opening in the circumferential direction thereof, the vertical dimension of the blowing opening of the casing being smaller than that of the fan and the transverse dimension thereof being larger than the diameter of the fan but smaller than the width of the air conditioner body.

4. The air conditioner according to claim 1, further comprising:

a sprinkler means for sprinkling water over the water cooling type condenser;

a drain hose connected to the sprinkler means to drain outside the air conditioner body water collected in the sprinkler means; and a drain hose housing section formed integral to the rear side of the air conditioner body and enabling the open front end portion of the drain hose to be fitted into the section while keeping the drain hose bent upward on the way of it.

5. The air conditioner according to claim 4, wherein the drain hose housing section includes a cut-away portion extending from a lower edge of the rear side of the air conditioner body to a certain height, and plural curved pieces formed on the top of the cut-away portion, projecting alternately forward and backward, and wherein each of these curved pieces is made semi-circular and when the adjacent ones projected forward and backward are combined with each other, they form a circle.

6. An air conditioner comprising:

a compressor for compressing and circulating a coolant in a cooling circuit;

a condenser of the air cooling type for cooling and condensing the compressed coolant and having an air inlet side;

a condenser of the water cooling type for further cooling and condensing the coolant which has been cooled and condensed by the air cooling type condenser.

7. The air conditioner according to claim 6, further comprising a drain pan located under the evaporator and having a peripheral wall and air filter guides being protruding outward from the peripheral wall, the air filter being positioned by the air filter guides.

8. The air conditioner according to claim 6, further comprising:

a body of the air conditioner;

a motor housed in the body and having a rotating shaft directed in the vertical direction;

a fan of the centrifugal multi-blade type attached to the rotating shaft of the motor; and a casing enclosing the fan and having a sucking opening in the axial direction thereof and a blowing opening in the circumferential direction thereof, the vertical dimension of the blowing opening of the casing being smaller than that of the fan and the transverse dimension thereof being larger than the diameter of the fan but smaller than the width of the air condition body.

9. The air conditioner according to claim 6, further comprising:

a sprinkler means for sprinkling water over the water cooling condenser;

a drain hose connected to the sprinkler means to drain outside the air conditioner body water collected in the sprinkler means; and a drain hose housing section formed integral to the rear side of the air conditioner body and enabling the open front end portion of the drain hose to be detachably fitted into the drain hose housing section while keeping the drain hose bent upward on the way of it.

10. The air conditioner according to claim 9, wherein the drain hose housing section includes a cut-away portion extending from a lower edge of the rear side of the air conditioner body to a certain height, and plural curved pieces formed on the top of the cut-away portion, projecting alternately forward and backward, and wherein each of these curved pieces is made semi-circular and when the adjacent one projected forward and backward are combined with each other, they form a circle.

11. An air conditioner comprising:

a compressor having sucking and discharging ports;

a condenser of the air cooling type having an inlet port connected to the discharging port of the compressor and an outlet port;

a condenser of the water cooling type having an inlet port connected to the outlet port of the condenser of the air cooling type and an outlet port;

a regulator connected to the outlet port of the condenser of the water cooling type;

an evaporator connected between the regulator and the sucking port of the compressor;

an air conditioner body housed the compressor, the air and water cooling type condensers, the regulator and the evaporator, a sprinkler for sprinkling water over the water cooling type condenser;

a drain hose having an open front end portion, connected to the sprinkler to drain outside the air conditioner body water collected in the sprinkler; and a drain hose housing section formed integral tot eh rear side of the air conditioner body and enabling the open front end portion of the drain hose to be fitted into the section while keeping the drain hose bent upward, the drain hose housing section including a cut-away portion extending from a lower edge of the rear side of the air conditioner body, and plural curved pieces formed on the top of the cut-away portion, projecting alternately forward and backward, and wherein each of these curved pieces is semi-circular and form a circle when the adjacent ones projected forward and backward are combined with each other.

12. An air conditioner comprising:

a compressor for compressing and circulating a coolant in a cooling circuit;

a condenser of the air cooling type for cooling and condensing the compressed coolant;

a condenser of the water cooling type for further cooling and condensing the coolant which has been cooled and condensed by the air cooling type condenser;

an evaporator for evaporating the condensed coolant;

an air conditioner body housed the compressor, the air and water cooling type condenser, the regulator and the evaporator;

a sprinkler for sprinkling water over the water cooling type condenser;

a drain hose having an open front end portion, connected to the sprinkler to drain outside the air conditioner body water collected in the sprinkler; and a drain hose housing section formed integral to the rear side of the air conditioner body and enabling the open front end portion of the drain hose to be detachably fitted into the drain hose housing section while keeping the drain hose bent upward, the drain hose housing section including a cut-away portion extending from a lower edge of the rear side of the air conditioner body, and plural curved pieces formed on the top of the cut-away portion, projecting alternately forward and backward, and wherein each of these curved pieces is semi-circular and form a circle when the adjacent ones projected forward and backward are combined with each other.

* * * * *